US010041164B2

(12) United States Patent
Li et al.

(10) Patent No.: US 10,041,164 B2
(45) Date of Patent: Aug. 7, 2018

(54) METHOD FOR PREPARING STAINLESS REINFORCING STEEL BAR RESISTANT TO CORROSION OF CHLORIDE IONS

(71) Applicant: University of Science and Technology Beijing, Beijing (CN)

(72) Inventors: Xiaogang Li, Beijing (CN); Xuequn Cheng, Beijing (CN); Chaofang Dong, Beijing (CN); Cuiwei Du, Beijing (CN); Dawei Zhang, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 326 days.

(21) Appl. No.: 15/070,287

(22) Filed: Mar. 15, 2016

(65) Prior Publication Data

US 2017/0058391 A1 Mar. 2, 2017

(30) Foreign Application Priority Data

Aug. 31, 2015 (CN) ..... 2015 1 0549858

(51) Int. Cl.
*C23C 10/12* (2006.01)
*C22C 38/18* (2006.01)
(Continued)

(52) U.S. Cl.
CPC ..... *C23C 10/40* (2013.01); *C22C 38/02* (2013.01); *C22C 38/04* (2013.01); *C22C 38/20* (2013.01);
(Continued)

(58) Field of Classification Search
CPC ..... C23C 10/32; C23C 10/38; C23C 10/40; C23C 10/54; C22C 38/02; C22C 38/04; C22C 38/20; C22C 38/22; C22C 38/28
See application file for complete search history.

(56) References Cited

U.S. PATENT DOCUMENTS 3,728,149 A 4/1973 Forand, Jr. et al.
3,768,987 A 10/1973 Forstmann et al.

FOREIGN PATENT DOCUMENTS

CN 101333639 A 12/2008
JP 48-32737 A 5/1973
(Continued)

OTHER PUBLICATIONS

Chinese Office Action, dated Aug. 26, 2016, for Chinese Application No. 201510549858.8, 9 pages. (with English Translation).

*Primary Examiner* — Lois L Zheng
(74) *Attorney, Agent, or Firm* — Seed Intellectual Property Law Group LLP

(57) ABSTRACT

This present invention provides a method for preparing a stainless reinforcing steel bar resistant to corrosion of chloride ions, and belongs to the technical field of corrosion-resistant materials. This method particularly comprises the steps of: selecting a reinforcing steel bar blank, and performing oil removing, rust removing, water washing, and drying treatments on the surface of the reinforcing steel bar blank to be treated, or directly performing sand blasting or shot blasting on a reinforcing steel bar blank whose surface is only slightly rusted; placing the reinforcing steel bar blank in a chromium-containing environment, and keeping at a certain temperature for a certain time such that chromium in the environment is capable of diffusing into the surface of the reinforcing steel bar blank to form a chromium-containing diffusion layer, wherein an area in the diffusion layer where the weight content of Cr exceeds 12% meets the basic component requirements for a stainless steel, and this area is the effective diffusion layer described in this invention; and performing cooling treatment on the heat diffusion treated reinforcing steel bar. In this invention, a reinforcing steel bar blank is pre-formed, a heat diffusion technique is optimized, and the corrosion resistance to chloride ions of the stainless
(Continued)

reinforcing steel bar of this invention is superior to that of the 316L stainless reinforcing steel bar.

4 Claims, 1 Drawing Sheet

(51) Int. Cl.

| | |
|---|---|
| ***C23C 10/40*** | (2006.01) |
| ***C22C 38/28*** | (2006.01) |
| ***C22C 38/22*** | (2006.01) |
| ***C22C 38/20*** | (2006.01) |
| ***C22C 38/04*** | (2006.01) |
| ***C22C 38/02*** | (2006.01) |
| ***C23C 10/60*** | (2006.01) |
| *C23C 10/38* | (2006.01) |

(52) U.S. Cl.
CPC ..... *C22C 38/22* (2013.01); *C22C 38/28* (2013.01); *C23C 10/60* (2013.01)

(56) References Cited

FOREIGN PATENT DOCUMENTS

| | | | |
|---|---|---|---|
| JP | 48-66515 | A | 9/1973 |
| JP | 4-116152 | A | 4/1992 |
| JP | 4-354862 | A | 12/1992 |

METHOD FOR PREPARING STAINLESS REINFORCING STEEL BAR RESISTANT TO CORROSION OF CHLORIDE IONS

FIELD OF THE INVENTION

This invention belongs to the field of corrosion-resistant materials, and relates to a method for preparing a stainless reinforcing steel bar resistant to corrosion of chloride ions.

BACKGROUND OF THE INVENTION

Typically, normal reinforcing steel bars have good corrosion resistance in concretes. This is because the reinforcing steel bar will form a compact passivation film in a highly basic environment, and this layer of compact passivation film will prevent the evolution and development of corrosion. However, once the concentration of chloride ions in concrete exceeds a certain critical value, this layer of passivation film will have a drastically reduced stability or even will be broken down, finally resulting in remarkable corrosion of reinforcing steel bars. The expansion effect of corrosion products will accelerate the ineffectiveness of reinforced concrete structures.

As marine resources are developed by human beings, reinforced concrete facilities serving in the marine environment are in an environment with a high concentration of chloride ions, the resultant problems with the drastic reduction of the structural durability induced by the rust corrosion of reinforcing steel bars are increasingly severe. The same challenges are encountered in the cold areas where chloride salt snow melters are used in large quantities.

At present, the prevention techniques in the world for improving the corrosion resistance to chloride ions mainly comprises two following major types:

(1) Surface Coating Reinforcing Steel Bars.

A surface coating reinforcing steel bar blocks the channel between a corrosive medium and a reinforcing steel bar matrix by physical means so as to achieve the object of improving the corrosion resistance, and the main types are epoxy-coated reinforcing steel bars and hot-dip galvanized reinforcing steel bars. Although surface coating reinforcing steel bars have some application cases, there are still a plurality of drawbacks that cannot be overcome due to the limits of the processes themselves. For example, the breakage phenomena of coatings caused in the process of construction cannot be completely prevented, the epoxy-coated reinforcing steel bars will reduce the bond stress between concretes and reinforcing steel bars, and hot-dip galvanized reinforcing steel bars will damage concretes due to the volume expansion of the corrosion products of zinc, or the like.

(2) Matrix Corrosion-resistant Reinforcing Steel Bar

A matrix corrosion-resistant reinforcing steel bar refers to a reinforcing steel bar obtained by adding a corrosion-resistant alloy element to a normal reinforcing steel bar so as to improve the corrosion resistance of a reinforcing steel bar matrix. Intrinsically existing problems of surface coating reinforcing steel bars will not occur in matrix corrosion-resistant reinforcing steel bars, and the matrix corrosion-resistant reinforcing steel bar mainly include low-alloy corrosion-resistant reinforcing steel bars and stainless corrosion-resistant reinforcing steel bars.

The low-alloy corrosion-resistant reinforcing steel bar is one of research hotspots in recent years, and researchers have tried to add a small amount of corrosion-resistant alloy elements such as Ni, Cr, etc. to a normal reinforcing steel bar so as to improve the overall corrosion resistance of the reinforcing steel bar. Although the alloyed corrosion-resistant reinforcing steel bars have certain advantages compared to the surface coating reinforcing steel bars, very few successful applications have been reported so far. This is because the addition of a small amount of corrosion-resistant alloy elements is limited with respect to the improvement of the corrosion resistance of reinforcing steel bars, and it is still very difficult to meet the requirements for long-term safe services of reinforced concretes in high-chlorine environments. Stainless corrosion-resistant reinforcing steel bars, particularly two-phase stainless reinforcing steel bars, have excellent corrosion-resistant properties to high-chlorine environment corrosion, and the expected lifetime for safe service in most marine environments in the world exceeds one hundred years. However, their high production costs limit the large-scale applications thereof.

Therefore, the invention of a reinforcing steel bar product, which has a corrosion resistance to chloride ions reaching or even exceeding those of the existing stainless reinforcing steel bars and has a relatively low production cost, has an extremely large prospect for application. This invention forms a stainless surface layer, of which the chemical components meet the requirements for stainless and the corrosion resistance is excellent, on the surface of a reinforcing steel bar, by implementing a heat diffusion technique on a pre-formed reinforcing steel bar blank.

SUMMARY OF THE INVENTION

The object of this present invention is to provide a method for preparing a stainless reinforcing steel bar resistant to corrosion of chloride ions. The stainless reinforcing steel bar prepared by this method has a very high scratch resistance and excellent corrosion resistance to chloride ions.

A method for preparing a stainless reinforcing steel bar resistant to corrosion of chloride ions, characterized by having the following steps of:

(a) selecting a reinforcing steel bar blank, and performing oil removing, rust removing, water washing, and drying treatments on the surface of the reinforcing steel bar blank to be treated, or directly performing sand blasting or shot blasting on a reinforcing steel bar blank whose surface is only slightly rusted; wherein the reinforcing steel bar blank has the following chemical ingredients in terms of percentage by weight:

C: 0.01-0.08 wt %, Mn: 0.10-0.50 wt %, P: ≤0.04 wt %, S: ≤0.03 wt %, Si: 0.2-0.6 wt %, Cr: 2.0-8.0 wt %, Mo: 1.50-2.50 wt %, Cu: 0.08-0.35 wt %, Ti: 0.10-0.40 wt %, and Fe and inevitable impurities as the balance;

(b) performing heat diffusion by placing the reinforcing steel bar blank in a chromium-containing environment, and keeping at a certain temperature for a certain time such that chromium in the environment is capable of diffusing into the surface of the reinforcing steel bar blank to form a chromium-containing diffusion layer, wherein an area in the diffusion layer where the weight content of Cr exceeds 12% meets the basic component requirements for a stainless steel, and this area is the effective diffusion layer described in this invention, and an effective diffusion layer having a chromium content exceeding 12% in the diffusion layer has a thickness exceeding 10 μm; and (c) performing cooling treatment on the reinforcing steel bar which has been treated by heat diffusion; wherein after the heat diffusion treatment is completed and after the heat diffusion treatment container is cooled to 100° C. or less along with the heat diffusion treatment furnace, the heat diffusion treatment container is withdrawn from the heat diffusion treatment furnace and subjected to air cooling to room temperature continuously, and then the reinforcing steel bar is separated from a heat diffusion powder.

Here, said heat diffusion in step (b) comprises the steps of: charging the surface treated reinforcing steel bar blank and a heat diffusion powder into a heat diffusion container, wherein the total volume of the reinforcing steel bar blank and the heat diffusion powder does not exceed 95% of the volume of the heat diffusion container. The above heat diffusion powder is formulated from 45% of an aluminum oxide powder (100-200 mesh), 50% of a chromium-iron alloy powder (containing about 70% of chromium, 100-200 mesh), and 5% of ammonium chloride in terms of percentage by weight. The heat diffusion container charged with the reinforcing steel bar blank and a diffusion treatment agent is placed and heated in a heating furnace, wherein the heating speed is controlled at 4-6° C. per minute, the temperature is maintained constant for 2.0-4.0 hours when the temperature reaches 800-950° C., and then the heating is stopped. The heat diffusion container may be rotated at a rotation speed of 5-20 rounds per minute in the process of heating and maintaining the temperature constant so as to perform heat treatment on the reinforcing steel bar within the heat treatment container to allow uniform heating while increasing the possibility of collision between the heat diffusion powder and the reinforcing steel bar blank.

The ingredients of the reinforcing steel bar blank of this invention are as follows:

C has an effect of improving the strength of reinforcing steel bars, and the higher the carbon content, the higher the strength and hardness of reinforcing steel bars are; however, excessively high carbon content does not only reduce plasticity and toughness, but also significantly reduces the corrosion resistance of reinforcing steel bars. On the other hand, C is prone to form a compound with Cr in the stage of heat diffusion treatment to prevent Cr atoms from diffusion into the matrix, and thereby the thickness of the stainless layer is reduced. Therefore, the C content is controlled at 0.01-0.08 wt % in this invention, and the lower the better.

Mn is a strengthening element, which can significantly improve the strength of reinforcing steel bars, and the higher the manganese content, the higher the strength of reinforcing steel bars is; however, excessively high manganese content may reduce the plasticity and pitting resistance of reinforcing steel bars. Therefore, the Mn content in this invention is controlled at 0.10-0.50 wt %.

Although P may improve corrosion resistance, it is prone to cause segregation of steel so as to reduce mechanical properties. The P content in this invention is controlled at 0.04 wt % or less.

S in steel is prone to cause the generation of cracks in the process of rolling, and may further generate MnS inclusion at the same time. The S content in this invention is controlled at 0.03 wt % or less.

Si is a strengthening element, which can strengthen and improve the strength of reinforcing steel bars by solid solution, and can perform effective deoxidization and reduce inclusions in steel at the same time. If the silicon content is relatively low, then the oxygen content in molten steel is high; however, if the silicon content is excessively high, then the plasticity of reinforcing steel bars may be reduced. Therefore, the Si content in this invention is controlled at 0.2-0.6 wt %.

Cr in this invention has the following at least 3 effects: (1) as a main ferrite forming element, Cr can greatly improve the heat diffusion rate of chromium atoms; (2) the element Cr can inhibit the element C in the core portion of the matrix from diffusion to the outer layer in the process of heat diffusion, and plays an role in carbon fixation; (3) the corrosion resistance of reinforcing steel bar blanks can be improved, wherein once the stainless layer on the surface of the reinforcing steel bar is broken, the exposed reinforcing steel bar matrix may generate a compact chromium-containing rust corrosion products due to containing a certain amount of chromium, and the rust corrosion products stack at a place where breakage occurs and may prevent further development of the rust corrosion at this place. The higher the Cr content, the higher the corrosion resistance of reinforcing steel bar blanks is and the faster the heat diffusion rate of chromium atoms is; however, excessively high content results in increased cost. The Cr content in this invention is controlled at 2.0-8.0 wt %.

Mo can improve the properties of pitting resistance and crevice corrosion resistance of the reinforcing steel bars, and can promote the property of chromium to form a compact oxide. Generally, pitting resistance equivalent number (PREN) is used to evaluate the property of pitting resistance of stainless steel, and the mathematical expression thereof is PREN=% Cr+3.3×% Mo, wherein the higher the PREN value the more excellent the corrosion resistance is. Therefore, the higher the Mo content, the stronger the pitting resistance of reinforcing steel bars is. However, increased Mo content will result in increased production cost. The Mo content in this invention is controlled at 1.50-2.50 wt %.

Cu in this invention has the following 3 effects: (1) since Cu and Cr have the same atom radius and Cu belongs to a low-melting metal and is extremely prone to escape from its original position in a high-temperature diffusion process to provide more vacancies for the permeated Cr atoms, Cu can significantly promote the permeation speed and permeation amount of Cr; (2) the compactness at a place of the stainless layer where breakage occurs may be improved so as to slow the damage to the stainless layer near the breakage by corrosion products; (3) a certain amount of Cu may improve the corrosion resistance of the reinforcing steel bar blanks in an acidic environment. When the Cu content is excessively high in reinforcing steel bars, it is prone to fracture when rolling. The Cu content in this invention is controlled at 0.08-0.35 wt %.

Ti is a strong carbide forming element, which may play an role in carbon fixation in the process of heat diffusion, and the content thereof is generally about 5 times of the carbon content; and meanwhile, Ti further inhibits the growth of crystal grains in the process of heat diffusion. The Ti content in this invention is controlled at 0.10-0.40 wt %.

The advantages of this invention are as follows:

(1) A reinforcing steel bar blank is pre-formed. In this invention, a part of alloy elements consisting a stainless steel, such as carbon, manganese, silicon, molybdenum, chromium, phosphorous, sulfur, etc., are added and controlled at respective contents during metallurgical process so as to provide a reinforcing steel bar blank in which a stainless layer is formed on the surface only by surface-permeating one or two elements via a heat diffusion technique. Therefore, by using a method of pre-forming a reinforcing steel bar blank, it is possible to produce a reinforcing steel bar at a relatively low cost, in which the inner matrix is an inexpensive low-alloy steel and the outer layer is a stainless layer with excellent corrosion resistance; and meanwhile, the reinforcing steel bar blank itself also has certain corrosion resistance and may inhibit further development of the rust corrosion at a place of the stainless layer where breakage occurs.

(2) A heat diffusion technique is optimized. By adding a certain amount of element Cr and element Cu to a preformed reinforcing steel bar, this technique greatly improves the heat diffusion rate of chromium and may achieve the completion of the heat diffusion process of element chromium at 950 degrees or less. Therefore, the optimized heat diffusion technique can save a large amount of energy and working hours.

(3) In the reinforcing steel bar blank of this invention, the content of Cr in the effective diffusion layer formed in the process of heat diffusion is greater than 12%, which meets the basic component requirements for stainless, and the thickness of this effective diffusion layer is greater than 10 μm, which ensures the service life of reinforcing steel bars. A potentiodynamic scanning measurement technique is used to test the critical chloride ion concentrations of the stainless reinforcing steel bar of this invention, a 316L stainless reinforcing steel bar, and a carbon steel reinforcing steel bar in simulated concrete pore solutions at pH=12.6, and the values thereof are 6.8 mol/L, 4.2 mol/L, and 0.06 mol/L, respectively. The results of corrosion resistance tests indicate that the corrosion resistance to chloride ions of the stainless reinforcing steel bar of this invention is superior to that of the 316L stainless reinforcing steel bar.

DETAILED DESCRIPTION OF THE INVENTION

Figure 1:
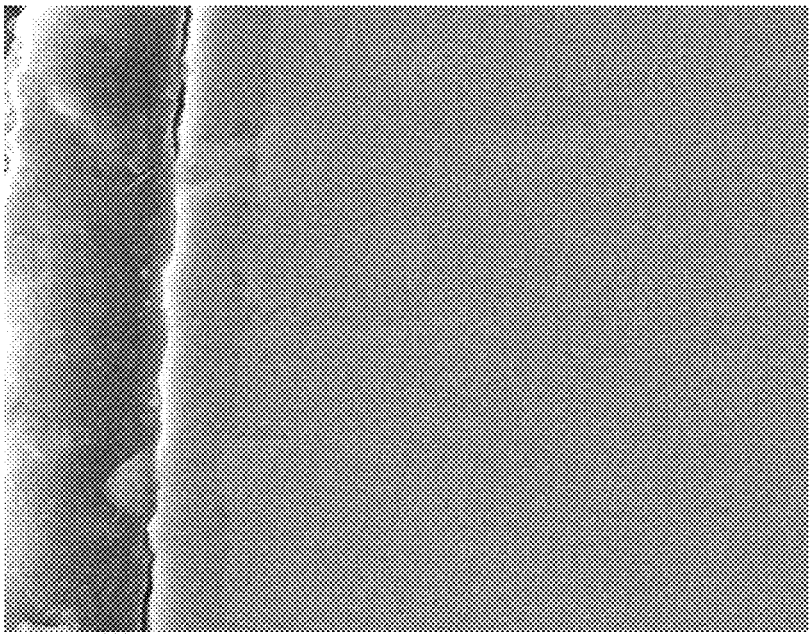
FIG. 1 is a sectional morphology of an Example of this invention.

The ingredients of the reinforcing steel bar blanks of the Examples and the Comparative Example of this invention can be seen in Table 1.

TABLE 1

The chemical ingredient analysis results of the main alloy elements in Examples of reinforcing steel bar blanks in this invention and those of the Comparative Example (wt %)

| Sample No. | C | Mn | Si | Cr | Mo | Cu | Ti |
|---|---|---|---|---|---|---|---|
| A (Comparative Example) | 0.196 | 1.57 | 0.57 | 0.08 | / | 0.01 | 0.002 |
| B | 0.031 | 0.15 | 0.24 | 2.11 | 2.08 | 0.09 | 0.27 |
| C | 0.055 | 0.13 | 0.26 | 2.08 | 2.11 | 0.32 | 0.26 |
| D | 0.039 | 0.13 | 0.24 | 7.9 | 2.05 | 0.11 | 0.28 |
| E | 0.062 | 0.14 | 0.25 | 7.8 | 2.13 | 0.35 | 0.26 |

The Comparative Example was an industrially produced normal HRB400 reinforcing steel bar. The process flow of the reinforcing steel bar blank was: molten iron desulfurization pretreatment, smelting in an electric furnace or a top and bottom combined blown converter, refining outside of furnace, continuous casting, cast blank heating, rolling, and cold bed air cooling.

The surface treated reinforcing steel bar blanks of the Comparative Example and the Examples, as well as a heat diffusion powder, were charged into a heat diffusion container. Here, the heat diffusion powder was formulated from 45% of an aluminum oxide powder (150 mesh), a 50% of a chromium-iron alloy powder (containing about 70% of chromium, 150 mesh), and 5% of ammonium chloride by weight. The heat diffusion container charged with the reinforcing steel bar blank and a diffusion treatment agent were placed and heated in a heating furnace, wherein the heating speed was controlled at about 5° C. per minute, the temperature was maintained constant for 2.0 hours when the temperature reached 930° C., and then the heating was stopped. After the completion of the treatment of heat diffusion, the heat diffusion treatment container was withdrawn from the heat diffusion treatment furnace when the heat diffusion treatment container was cooled to 100° C. or less along with said heat diffusion treatment furnace, air cooling was continued to room temperature, and the reinforcing steel bar was separated from the heat diffusion powder. The main process parameters of the samples of the Examples of this invention and the Comparative Example subjected to the treatment of heat diffusion were as shown in Table 2.

TABLE 2

The testing results of the effective diffusion layers where the weight content of chromium was above 12% in the Examples and the Comparative Example after heat diffusion treatment.

| Sample No. | Average Thickness (μm) | Average Cr Content (wt %) | Pitting Resistance Equivalent Number (PREN = % Cr + 3.3 × % Mo) |
|---|---|---|---|
| A (Comparative Sample) | <3 μm | / | / |
| B | 10 | 17.51 | 24.4 |
| C | 11 | 24.76 | 31.7 |
| D | 12 | 19.63 | 26.4 |
| E | 18 | 29.12 | 36.2 |

The results of the contents of main alloy elements in effective diffusion layers of the Examples of this invention detected by EDS can be seen in Table 3.

TABLE 3

Results of contents of main alloy elements in the effective diffusion layers of Examples in this invention detected by EDS

| Example | C | Mn | Si | Cr | Mo | Cu | Ti |
|---|---|---|---|---|---|---|---|
| B | 0.059 | 0.14 | 0.22 | 19.32 | 1.96 | 0.08 | 0.21 |
| C | 0.062 | 0.11 | 0.23 | 25.1 | 2.05 | 0.29 | 0.22 |
| D | 0.047 | 0.13 | 0.23 | 20.35 | 1.82 | 0.09 | 0.25 |
| E | 0.079 | 0.12 | 0.25 | 29.66 | 2.11 | 0.31 | 0.23 |

A sectional morphology of an Example of this invention was shown in FIG. 1.

Figure 2:
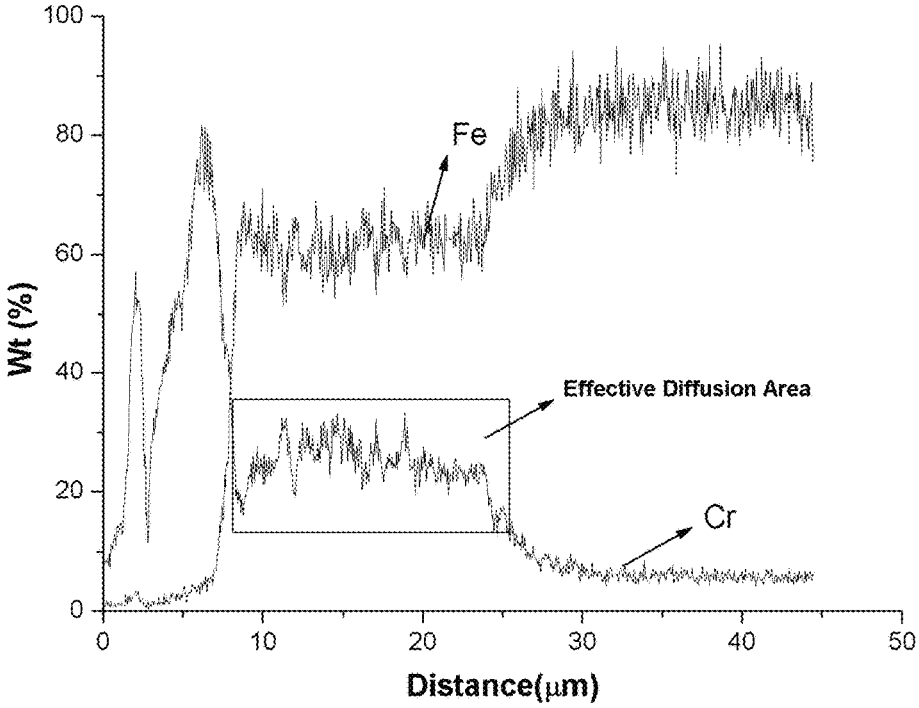
FIG. 2 is a graph of element line scanning analysis results.

The element line scanning analysis results of an Example of this invention were shown in FIG. 2.

What is claimed is:

1. A method for preparing a stainless reinforcing steel bar resistant to corrosion of chloride ions, comprising the following steps of:

(a) selecting a reinforcing steel bar blank, and performing oil removing, rust removing, water washing, and drying treatments on the surface of the reinforcing steel bar blank to be treated, or directly performing sand blasting or shot blasting on a reinforcing steel bar blank whose surface is only slightly rusted; wherein the reinforcing steel bar blank has the following chemical ingredients in terms of percentage by weight:

C: 0.01-0.08 wt %, Mn: 0.10-0.50 wt %, P: ≤0.04 wt %, S: ≤0.03 wt %, Si: 0.2-0.6 wt %, Cr: 2.0-8.0 wt %, Mo:

1.50-2.50 wt %, Cu: 0.08-0.35 wt %, Ti: 0.10-0.40 wt %, and Fe and inevitable impurities as the balance;

(b) performing heat diffusion by placing the reinforcing steel bar blank in a chromium-containing environment, and keeping at a certain temperature for a certain time such that chromium in the environment is capable of diffusing into the surface of the reinforcing steel bar blank to form a chromium-containing diffusion layer, in which an effective diffusion layer having a chromium content exceeding 12% has a thickness exceeding 10 μm; and (c) performing cooling treatment on the reinforcing steel bar which has been treated by heat diffusion; wherein after the heat diffusion treatment is completed and when a heat diffusion treatment container is cooled to 100° C. or less along with a heat diffusion treatment furnace, the heat diffusion treatment container is withdrawn from the heat diffusion treatment furnace and subjected to air cooling to room temperature continuously, and then the reinforcing steel bar is separated from a heat diffusion powder.

2. The method for preparing the stainless reinforcing steel bar resistant to corrosion of chloride ions as claimed in claim 1, wherein said heat diffusion in step (b) comprises the steps of: charging the surface treated reinforcing steel bar blank and a heat diffusion powder into the heat diffusion container, wherein the total volume of the reinforcing steel bar blank and the heat diffusion powder does not exceed 95% of the volume of the heat diffusion container; placing and heating the heat diffusion container charged with the reinforcing steel bar blank and the heat diffusion powder in a heating furnace, wherein a heating speed is controlled at 4-6° C. per minute; maintaining the temperature constant for 2.0-4.0 hours when the temperature reaches 800-950° C.; and then stopping heating.

3. The method for preparing the stainless reinforcing steel bar resistant to corrosion of chloride ions as claimed in claim 2, wherein the heat diffusion powder is formulated from 45% of a 100-200 mesh aluminum oxide powder, 50% of a 100-200 mesh chromium-iron alloy powder containing 70% of chromium, and 5% of ammonium chloride in terms of percentage by weight.

4. The method for preparing the stainless reinforcing steel bar resistant to corrosion of chloride ions as claimed in claim 2, wherein the heat diffusion container is rotated at a rotation speed of 5-20 rounds per minute in a process of heating and maintaining the temperature constant so as to perform heat treatment on the reinforcing steel bar within the heat treatment container to allow uniform heating while increasing the possibility of collision between the heat diffusion powder and the reinforcing steel bar blank.

* * * * *